US009494037B2

(12) United States Patent
Zhang et al.

(10) Patent No.: US 9,494,037 B2
(45) Date of Patent: Nov. 15, 2016

(54) INCLINED LAYERED SOLID-FILLING MINING METHOD IN ULTRATHICK COAL LAYER

(71) Applicant: CHINA UNIVERSITY OF MINING AND TECHNOLOGY, Jiangsu (CN)

(72) Inventors: Jixiong Zhang, Jiangsu (CN); Nan Zhou, Jiangsu (CN); Qiang Zhang, Jiangsu (CN); Jiwei Guo, Jiangsu (CN); Xiaoming Shen, Jiangsu (CN); Feng Ju, Jiangsu (CN); Haiqiang Jiang, Jiangsu (CN)

(73) Assignee: China University of Mining and Technology (CN)

( * ) Notice: Subject to any disclaimer, the term of this patent is extended or adjusted under 35 U.S.C. 154(b) by 0 days.

(21) Appl. No.: 14/891,288

(22) PCT Filed: Jan. 22, 2014

(86) PCT No.: PCT/CN2014/071088
§ 371 (c)(1),
(2) Date: Nov. 13, 2015

(87) PCT Pub. No.: WO2014/187163
PCT Pub. Date: Nov. 27, 2014

(65) Prior Publication Data

US 2016/0102553 A1 Apr. 14, 2016

(30) Foreign Application Priority Data

May 20, 2013 (CN) ..... 2013 1 0187986

(51) Int. Cl.

| | |
|---|---|
| ***E21F 15/02*** | (2006.01) |
| ***E21C 41/16*** | (2006.01) |
| ***E21D 23/04*** | (2006.01) |

(52) U.S. Cl.
CPC ..... *E21F 15/02* (2013.01); *E21C 41/04* (2013.01); *E21C 41/16* (2013.01); *E21D 23/0481* (2013.01)

(58) Field of Classification Search
CPC ..... E21F 15/02; E21F 15/04
See application file for complete search history.

(56) References Cited

U.S. PATENT DOCUMENTS 3,564,857 A * 2/1971 Hippel ..... E21D 23/0034 248/357

FOREIGN PATENT DOCUMENTS

| | | | |
|---|---|---|---|
| CN | 102003185 | 4/2001 | ..... E21C 41/20 |
| CN | 1354318 | 6/2002 | ..... E21C 41/18 |
| CN | 1260460 | 6/2006 | ..... E21C 41/22 |
| CN | 101586460 | 11/2009 | ..... E21C 41/16 |
| CN | 103306720 | 9/2013 | ..... E21D 19/00 |
| RU | 2229607 | 5/2004 | ..... E21F 15/06 |

OTHER PUBLICATIONS

International Search Report issued in application PCT/CN2014/071088, dated Apr. 16, 2014 (5 pgs).

* cited by examiner

*Primary Examiner* — Sunil Singh
(74) *Attorney, Agent, or Firm* — Hayes Soloway PC

(57) ABSTRACT

In an inclined layered solid-filling mining method in an ultrathick coal layer, tunnels and equipment are arranged according to a solid-filling mining method. An artificial roof for a lower layer is formed by metal meshes and bamboo fences of a first layer a solid-filling mining method. The method is repeated, until the entire ultrathick coal layer is finished. The method is repeated forming additional roofs for subsequent layers.

5 Claims, 5 Drawing Sheets

INCLINED LAYERED SOLID-FILLING MINING METHOD IN ULTRATHICK COAL LAYER

FIELD OF THE INVENTION

The present invention relates to an inclined layered solid-filling mining method in ultra-thick coal layer, which is especially applicable to exploitation of ultra-thick coal layers under surface constructions, railroads, or water bodies.

BACKGROUND OF THE INVENTION

The resource of ultra-thick coal layers (8-20 m) under constructions, railroads, and water bodies is widely distributed in China, and these coal layers are important coal layers for improving exploitation efficiency and yield in coal mines in China. At present, there are mainly two types of exploitation methods for ultra-thick coal layers (8-20 m) under constructions, railroads, and water bodies in China: the first type includes layered mining, caving mining, and thickness-limit mining, etc., which utilizes a spontaneous caving approach to manage coal roofs, and have the following problems: spontaneous roof caving may cause surface subsidence and damages to surface constructions and railroads, etc., and may result in settlement of ground water level and damage to the ecologic environment; the second type includes strip mining, large area coordinated mining, reducing subsidence by grouting mining, etc., though these mining methods have some surface subsidence control effects and can ensure safe use of surface constructions and railroads, they have disadvantages such as low level of mechanization, low recovery ratio, high production cost, low production efficiency, small scale or partially in research. Hence, it is urgent to develop a coal mining method that can effectively control strata movement, ensure safe use of surface constructions and railroads, etc., and efficiently recover ultra-thick coal layers (8-20 m) under constructions, railroads, and water bodies.

SUMMARY OF THE INVENTION

Technical Problem

The object of the present invention is to provide an inclined layered solid-filling mining method for ultra-thick coal layers under surface constructions, railroads, or water bodies.

Technical Scheme the inclined layered solid-filling mining method in ultra-thick coal layer disclosed in the present invention comprises the following steps:

a. dividing an ultra-thick coal layer into inclined layers having thickness of 2.5~4.5 m according to the thickness of the ultra-thick coal layer under surface construction, railroad, or water body, the structure of overlaying strata, and the protective rating of surface construction, determining the number of inclined layers, and adopting a layered mining downward filling order;

b. arranging tunnels and installing equipment according to a conventional solid-filling mining method, and mining a first working face in the first layer;

c. executing a first filling mining cycle conventionally, i.e., cutting the coal, advancing a scraper conveyer, advancing a filling mining hydraulic support, constructing an artificial roof on the bottom of the mine goaf sequentially, laying a metal mesh on the bottom of the mine goaf firstly, with the edge of the metal mesh arranged at 5 cm from the base of the filling mining hydraulic support, and then laying bamboo fences on the metal mesh, with the edge of the bamboo fences arranged at 5 cm from the edge of the metal mesh, and laying the metal mesh and bamboo fences along the direction parallel to the mining working face, till the bottom of the entire mine goaf is laid with the metal mesh and bamboo fences, then, after laying the metal mesh and bamboo fences, filling a solid material into the mine goaf and compacting the solid material with a rammer compactor, so as to complete the cycle in a first step length; continuing to execute a second filling mining cycle, i.e., under the cover of the filling mining hydraulic support, laying metal meshes and a bamboo fences on the bottom of the mine goaf and connecting the metal meshes and bamboo fences with the metal meshes and bamboo fences laid in the first filling mining cycle together respectively with iron wires, and then filling the mine goaf, so as to complete the cycle in a second step length; such a cycle is repeated, till the mining reaches to the protective coal pillars and thereby the filling mining of the first working face is completed;

d. moving the working face to the next working face in the first layer, and repeating step c, so as to carry out filling mining at all working faces in the first layer sequentially; meanwhile, 4 months after completing filing at the first mining working face in a first layer, carrying out mining filling for a second layer in the same way as that for the first layer at the corresponding position in the second layer, under the cover of the metal meshes, bamboo fences, and artificial roof, till the mining filling of all working faces in the second layer is completed;

e. repeating steps c and d, carrying out filling mining of the current layer under the cover of the artificial roof formed in the previous layer, till the mining filling of all layers in the entire ultra-thick coal layer is completed.

Benefits

The inclined layered solid-filling mining method in ultra-thick coal layer under a surface construction, railroad, or water body provided by the present invention has the following advantages: the mine goaf is filled with a solid material such as gangue, metal meshes and bamboo fences are laid and an artificial roof is constructed under the solid material, to provide cover for filling mining of the next layer; thus, on one hand, the surface subsidence problem is solved, and safe use of the surface construction is ensured; on the other hand, the coal recovery ratio is improved, the service life of the coal mine is prolonged, the resource of ultra-thick coal layers under surface constructions, railroads, and water bodies is released, and the resource recovery ratio of the coal mine is improved. The present invention solves the two major problems in the prior art: one is surface subsidence and damages to the surface construction or railroad, etc. which resulted from spontaneous caving of roof; and, the other one is low level of mechanization, low recovery ratio, high production cost, and low production efficiency, etc. Since a solid material such as gangue is used as the filling material in the present invention, the pollution of surface environment and the occupation of land are reduced, and strata movement and surface subsidence can be controlled effectively. The method is simple, with high production efficiency, low production cost and high practicability in the art.

AMONG THE FIGURES

Figure 1:
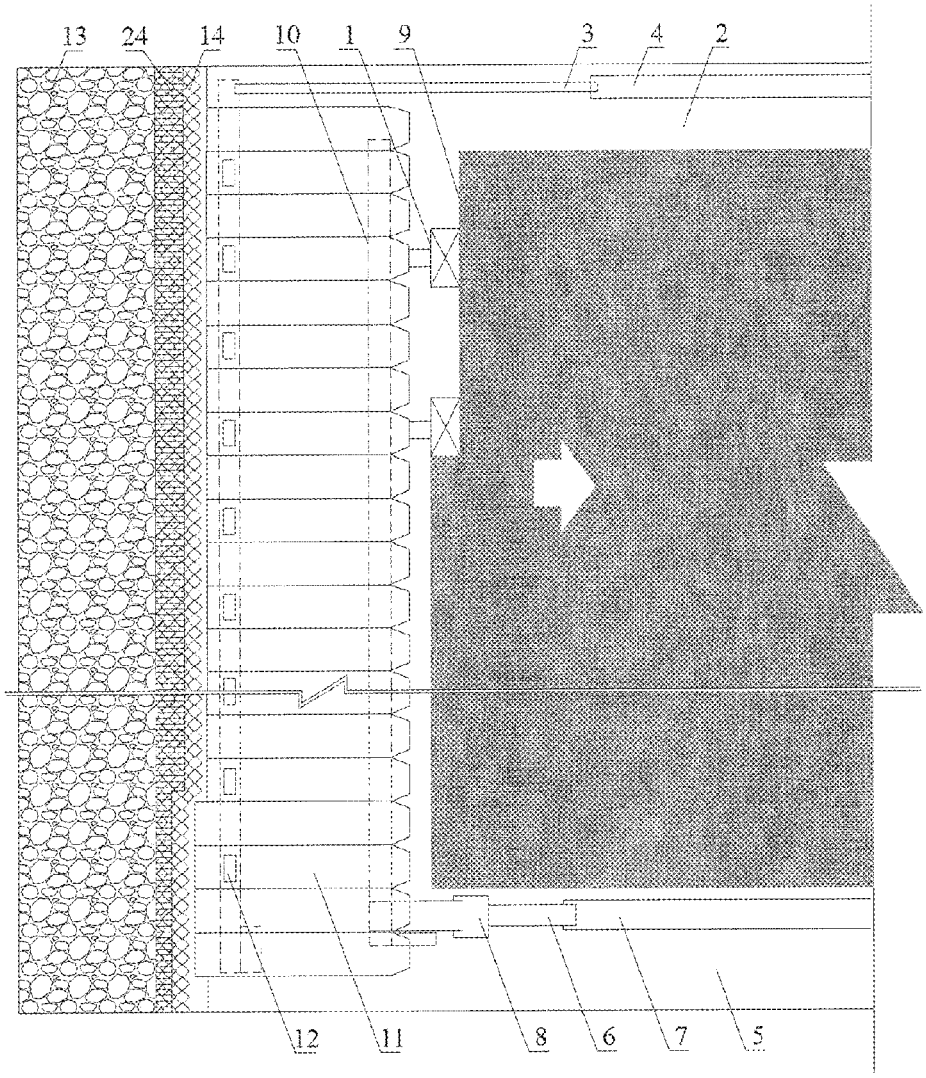
FIG. 1 is a top view of the layout of the first working face in the first layer according to the present invention.
Figure 2:
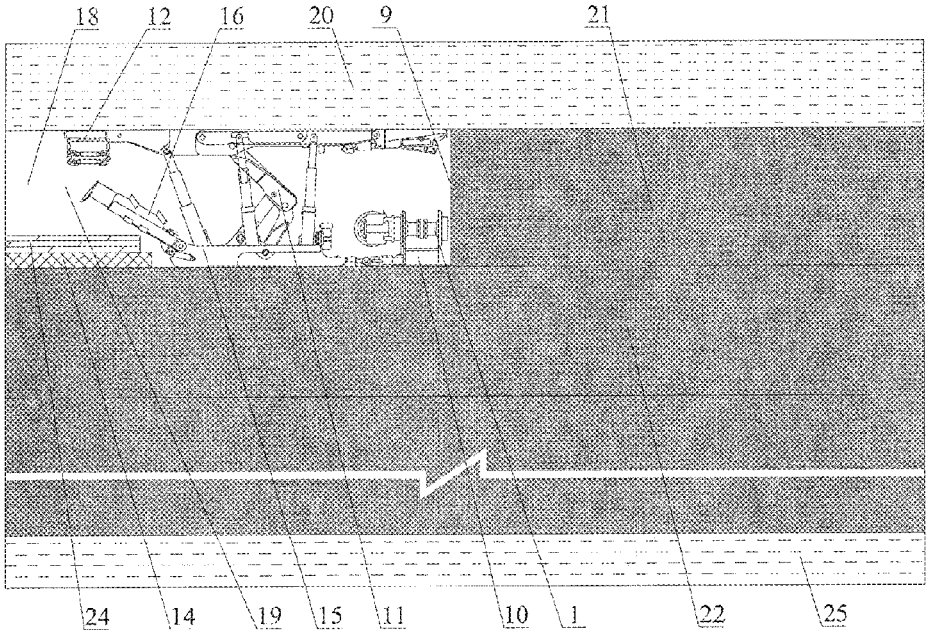
FIG. 2 is a side view of the first layer when metal meshes are laid in mine goaf in the first cycle according to the present invention.
Figure 3:
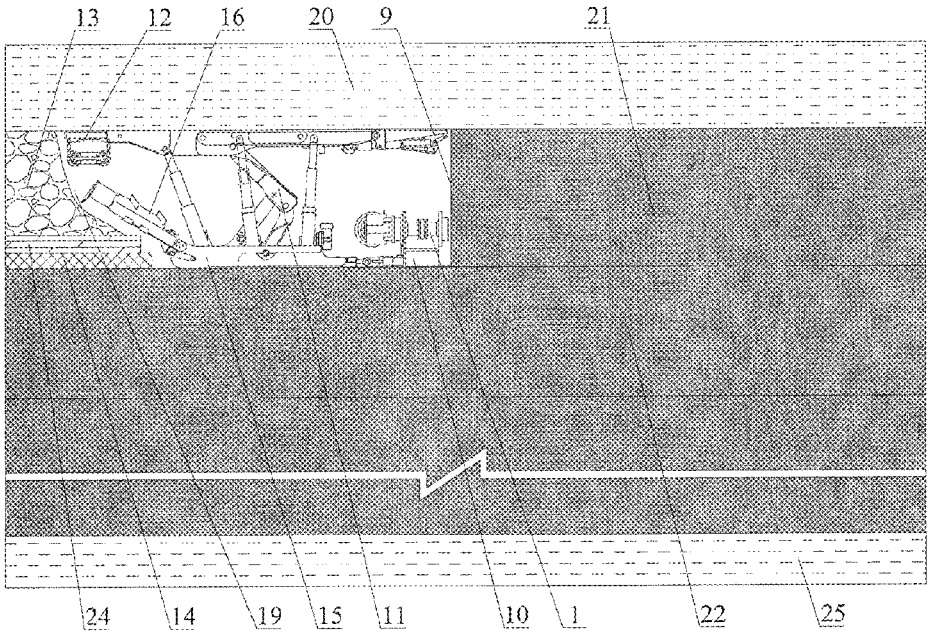
FIG. 3 is a side view of the first layer when solid materials are filled in a mine goaf in the first cycle according to the present invention.
Figure 4:
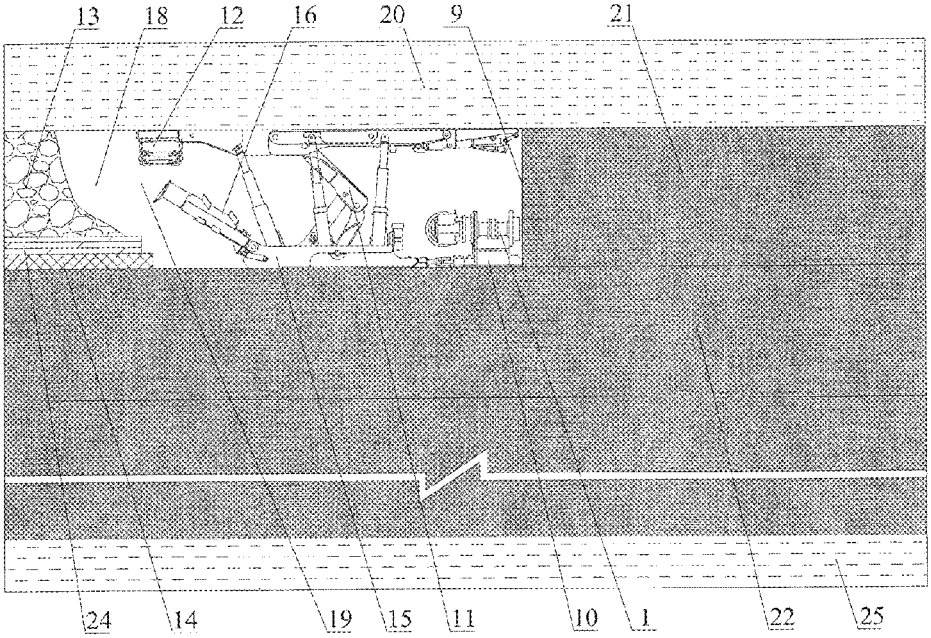
FIG. 4 is a side view of the first layer when coal mining is carried out in the second cycle according to the present invention.
Figure 5:
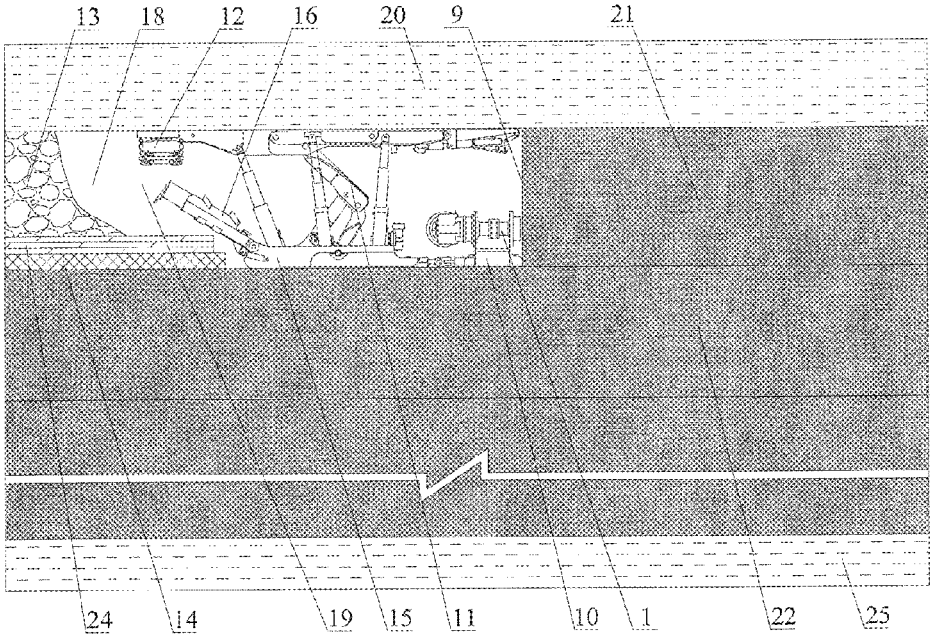
FIG. 5 is a side view of the first layer when metal meshes are laid in mine goaf in the second cycle according to the present invention.
Figure 6:
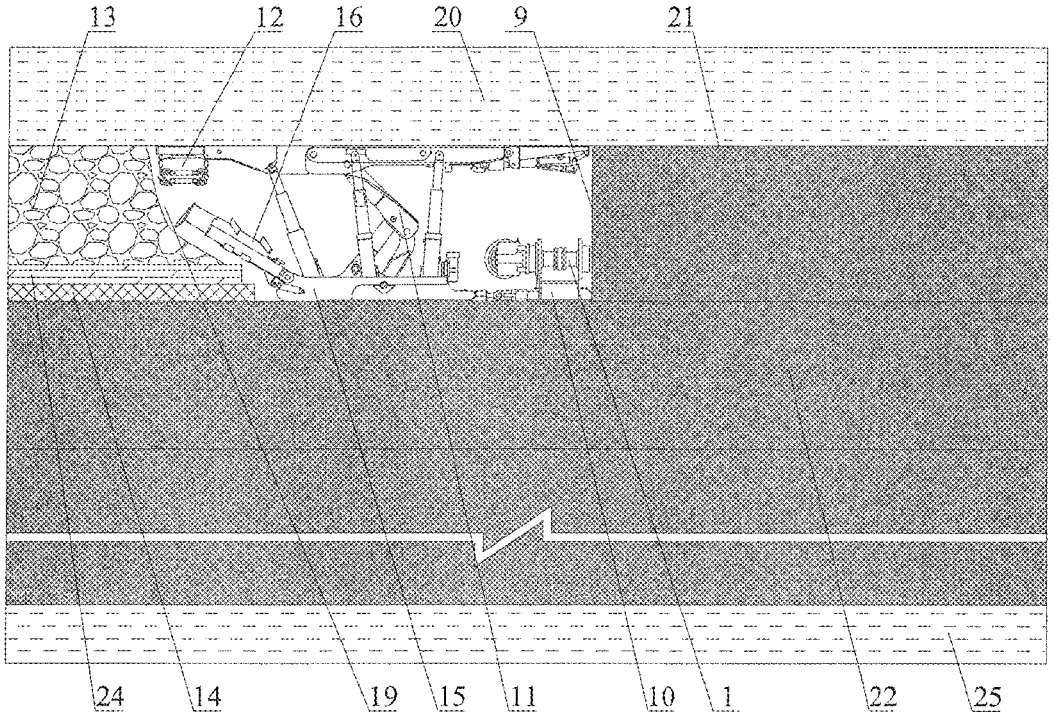
FIG. 6 is a side view of the first layer when solid materials are filled in a mine goaf in the second cycle according to the present invention.
Figure 7:
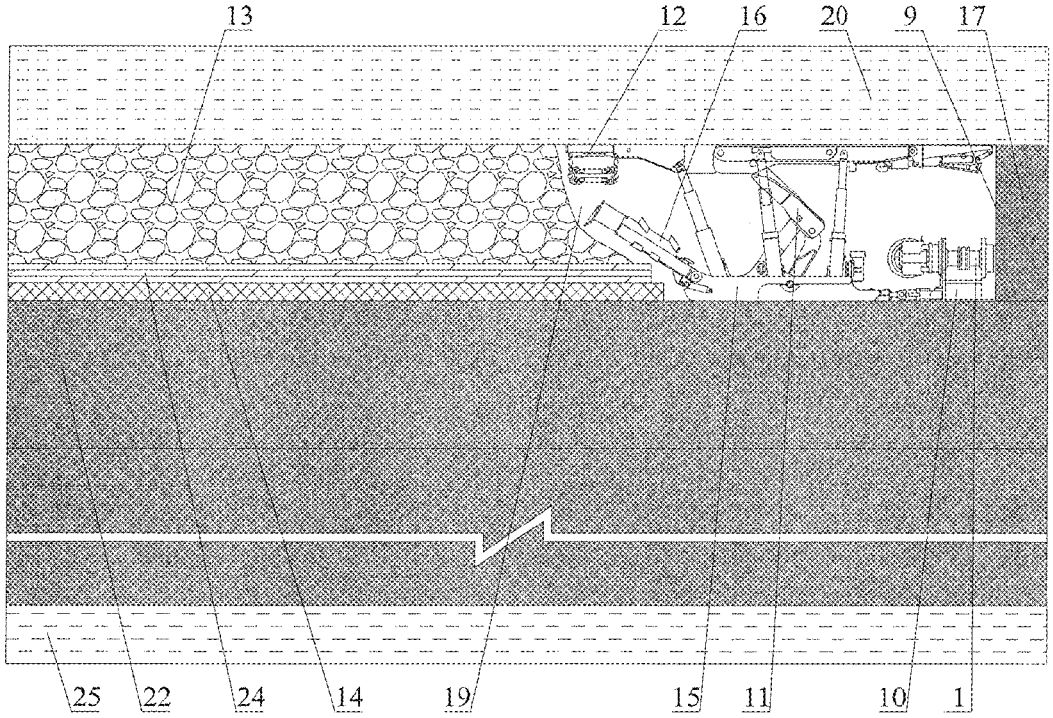
FIG. 7 is a side view of the first layer when the mining reaches to protective coal pillars.
Figure 8:
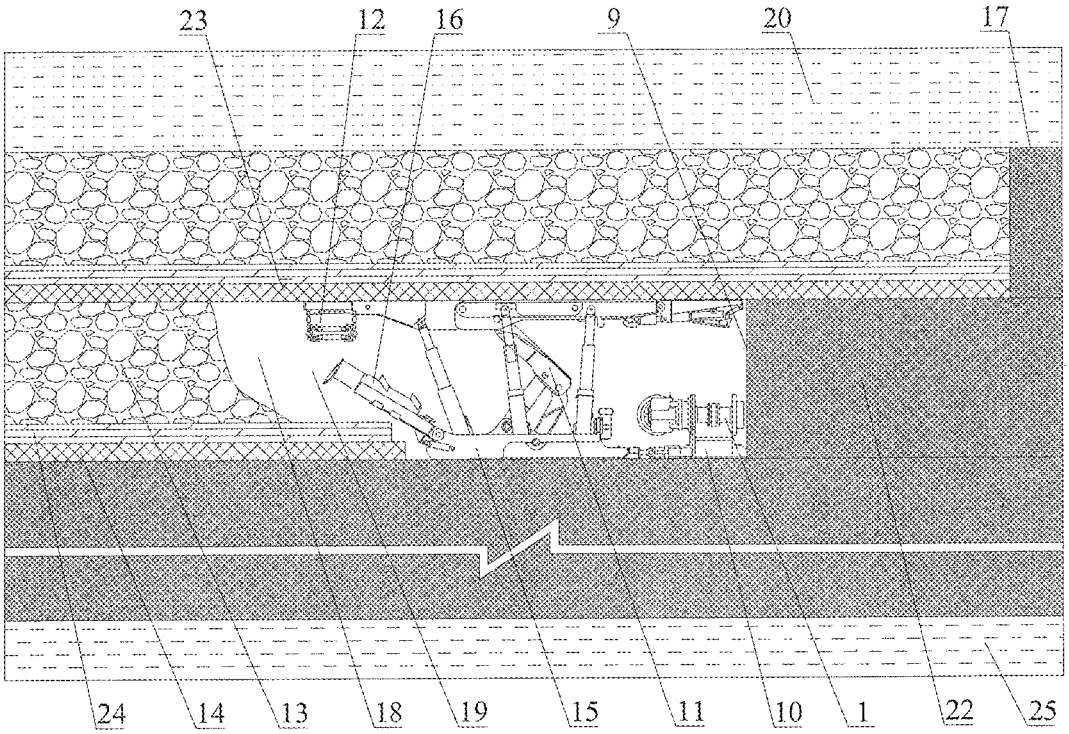
FIG. 8 is a side view of the second layer when coal mining is carried out according to the present invention.

1—coal mining machine, 2—material transport gangway, 3—self-advancing transfer conveyer, 4—belt-type material conveyer, 5—coal transport gangway, 6—coal transfer conveyer, 7—belt-type coal conveyer, 8—crushing machine, 9—coal mining working face, 10—scraper conveyer, 11—filling mining hydraulic support, 12—bottom-dump conveyer, 13—solid material, 14—metal mesh, 15—base, 16—rammer compactor, 17—protective coal pillar, 18—mined goaf, 19—filling working face, 20—overlying strata, 21—first layer, 22—second layer, 23—artificial roof, 24—bamboo fences, 25—floor.

DETAILED DESCRIPTION OF THE EMBODIMENTS

Hereunder the present invention will be further described according to an embodiment, with reference to the accompanying drawings:

The inclined layered solid-filling mining method in ultra-thick coal layer disclosed in the present invention comprises the following steps:

a. ultra-thick coal layer is divided into inclined layers having thickness of 2.5~4.5 m according to the thickness of the ultra-thick coal layer under a surface construction, railroad, or water body, the structure of overlaying strata, and the protective rating of surface construction, the number of inclined layers is determined, and a layered mining downward filling order is adopted;

b. tunnels and equipment are arranged according, to the conventional solid-filling mining method, to form a filling mining system, i.e., drilling out a vertical material filling well at an appropriate ground location, and a solid filling material transport gangway that communicates with the main haulage gangway is dug in the bottom of the vertical material filling well; a belt belt-type material conveyer 4 is deployed in the material transport gangway 2, a belt-type coal conveyer 7 is deployed in a coal transport gangway 5; a self-advancing transfer conveyer 3, a crushing machine 8, and a coal transfer conveyer 6 are deployed at the terminal of a coal mining working face 9; a filling mining hydraulic support 11, a scraper conveyer 10, and a coal mining machine 1 are deployed at the coal mining working face 9; a bottom-dump conveyer 12 and a rammer compactor 16 are deployed at a filling working face 19;

c. the first working face in a first layer 21 is mined first, i.e., cutting coal, pushing forward the scraper conveyer 10, and pushing forward the filling mining hydraulic support 11 is performed sequentially according to conventional mining method, then, an artificial roof 23 is constructed in the bottom of a mine goaf 18, i.e., a metal mesh 14 is laid on the bottom of the mine goaf 18 first, with the edge of the metal mesh 14 arranged at 5 cm from the base 15, to prevent the metal mesh 14 from fully covered by the solid material 13, then, a bamboo fence 24 is laid on the metal mesh 14, with the edge of the bamboo sheath 24 lagged for 5 cm from the edge of the metal mesh 14, to facilitate connection with the metal mesh 14, and metal mesh 14 and bamboo fences 24 are laid along a direction parallel to the coal mining working face 9, till the bottom of the entire mine goaf 18 is laid with metal mesh 14 and bamboo fences 24, next, after laying the metal mesh and bamboo fences, the mine goaf 18 is filled with the solid material 13, and the solid material 13 is compacted with the rammer compactor 16 to form a dense filling body, thus, a cycle in the first step length is completed; in the second cycle, mining is carried out in the same way as the first cycle, next, under the cover of the filling mining hydraulic support 11, a metal mesh 14 and a bamboo fence 24 are laid on the bottom of the mine goaf 18, and are connected to the metal mesh 14 and bamboo fence 24 laid in the first cycle together respectively with iron wires, then, filling is carried out in the same way as the first cycle, thus, the cycle in the second step length is completed; such a cycle work is repeated, till the mining reaches to the protective coal pillars 17, the filling mining of the first working face is completed.

d. the working face is moved to the next working face in the current layer, other working faces are mined and filled sequentially according to the filling and mining method of the first working face, till all the mining filling work is done for the first layer 21; in addition, the mining and filling for a second layer 22 is carried out in the same way as that for the first layer at the corresponding position in the second layer 22, under the cover of metal mesh 14, bamboo fences 24, and artificial roof 23, at the time of 4 months after the first working face of the first layer 21 is filled and mined; in that way, the mining and filling of the current layer is carried out under the cover of the artificial roof prepared in the previous layer, till the mining of the entire ultra-thick coal layer between the overlying strata 20 and the floor 25 is completed.

The invention claimed is:

1. A method for solid-fill mining of an ultra-thick coal layer, comprising steps of:

a. dividing an ultra-thick coal layer into a number of layers having a thickness of 2.5~4.5 m according to a thickness of the ultra-thick coal layer under an overlying surface;

b. arranging tunnels, installing equipment, and mining a first working face in a first coal layer by cutting the coal, advancing a scraper conveyer, and advancing a filling mining hydraulic support;

c. constructing an artificial roof for a second layer on a bottom of a mine goaf by laying a metal mesh on the bottom of the mine goaf formed in the first layer, with an edge of the metal mesh arranged spaced from a base of the filling mining hydraulic support, laying bamboo fences on the metal mesh, with an edge of the bamboo fences arranged spaced from the edge of the metal mesh, and laying the metal mesh and bamboo fences along a direction parallel to the first working face, until the bottom of the entire mine goaf is laid with the metal mesh and bamboo fences, after laying the metal mesh and bamboo fences, filling a solid material into the mine goaf and compacting the solid material, so as to complete a first mining cycle;

d. executing a second filling mining cycle, under the filling mining hydraulic support, laying a metal mesh and a bamboo fences on the bottom of the mine goaf and connecting the metal mesh and bamboo fences with the metal mesh and bamboo fences laid in the first filling mining cycle together respectively with iron wires, and filling the mine goaf, so as to complete the second mining cycle;

e. repeating steps c and d until mining reaches a protective coal pillar, whereupon filling and mining of the first working face is completed;

f. moving the first working face to a second working face, and repeating steps c-c, so as to carry out filling mining at working faces in the second layer under the first layer and; carrying out mining and filling of the second layer in a same manner as for the first layer at a corresponding position of the second layer, under cover of the artificial roof, after the first working face of the first layer is filled and mined, until mining and filling of working faces in the second layer is completed; and g. repeating steps c-f, to carry out mining and filling of a next layer under the artificial roof of the previous layer, until mining and filling of all layers in the ultra-thick coal layer is completed.

2. The method of claim 1, comprising arranging the edge of the bamboo fences 5 cm from the edge of the metal mesh.

3. The method of claim 1, wherein mining and filling of the second layer takes place 4 months after the first layer is filled and mined.

4. The method of claim 1, wherein the overlying surface includes a railroad, a water body or a building construction.

5. The method of claim 1, comprising compacting the solid material using a rammer compactor.

* * * * *

UNITED STATES PATENT AND TRADEMARK OFFICE

CERTIFICATE OF CORRECTION

PATENT NO. : 9,494,037 B2
APPLICATION NO. : 14/891288
DATED : November 15, 2016
INVENTOR(S) : Zhang et al.

It is certified that error appears in the above-identified patent and that said Letters Patent is hereby corrected as shown below:

Claim 1, Column 6, Line 5, “steps c-c” should be --steps c-e--.

Signed and Sealed this
Twelfth Day of September, 2017

Joseph Matal

Joseph Matal
*Performing the Functions and Duties of the*
*Under Secretary of Commerce for Intellectual Property and*
*Director of the United States Patent and Trademark Office*